US005181349A

United States Patent [19]

Schaffer

[11] Patent Number: 5,181,349

[45] Date of Patent: Jan. 26, 1993

[54] SELF-POWERED UNITARY PORTABLE GRANULAR PARTICLE EJECTOR TOOL

[75] Inventor: Stephen C. Schaffer, Brookfield, Conn.

[73] Assignee: Sandair Nevada, Inc., Las Vegas, Nev.

[21] Appl. No.: 923,320

[22] Filed: Jul. 31, 1992

Related U.S. Application Data

[63] Continuation-in-part of Ser. No. 762,920, Sep. 19, 1991, abandoned.

[51] Int. Cl.[5] ..... B24C 3/00

[52] U.S. Cl. ..... 51/410; 51/170 R; 51/427; 51/436; 51/439

[58] Field of Search ..... 51/170 R, 410, 427, 51/429, 436, 438, 439

[56] References Cited

U.S. PATENT DOCUMENTS

| | | | |
|---|---|---|---|
| 2,108,545 | 2/1938 | Minich | 51/436 |
| 2,441,441 | 5/1948 | Paasche | 51/427 |
| 2,574,578 | 11/1951 | Martinet | 51/427 |
| 3,032,929 | 5/1962 | Glesener | 51/427 |
| 4,090,334 | 5/1978 | Kurowski et al. | 51/436 |
| 4,333,277 | 6/1982 | Tasedan | 51/427 |

FOREIGN PATENT DOCUMENTS

| | | | |
|---|---|---|---|
| 3624023 | 7/1986 | Fed. Rep. of Germany | 51/429 |

*Primary Examiner*—M. Rachuba

*Attorney, Agent, or Firm*—Ware, Fressola, Van Der Sluys & Adolphson

[57] ABSTRACT

A symmetrically balanced unitary portable self-contained tool, suitable for single-hand operation, for ejecting a stream of granular particles toward a target sit combines a supply hopper containing the granular particles, a portable propellant container carrying compressed propellant liquid, a propellant release valve delivering propellant from the container via a constricted Venturi orifice to a mixing chamber positioned above the uppermost level of particles in the hopper, a delivery conduit connecting the lower portion of the supply hopper to the mixing chamber, and a nozzle connected to deliver a stream of granular particles aspirated from the supply hopper through the mixing chamber by the negative pressure differential created at the Venturi orifice.

15 Claims, 5 Drawing Sheets

FIG. 6
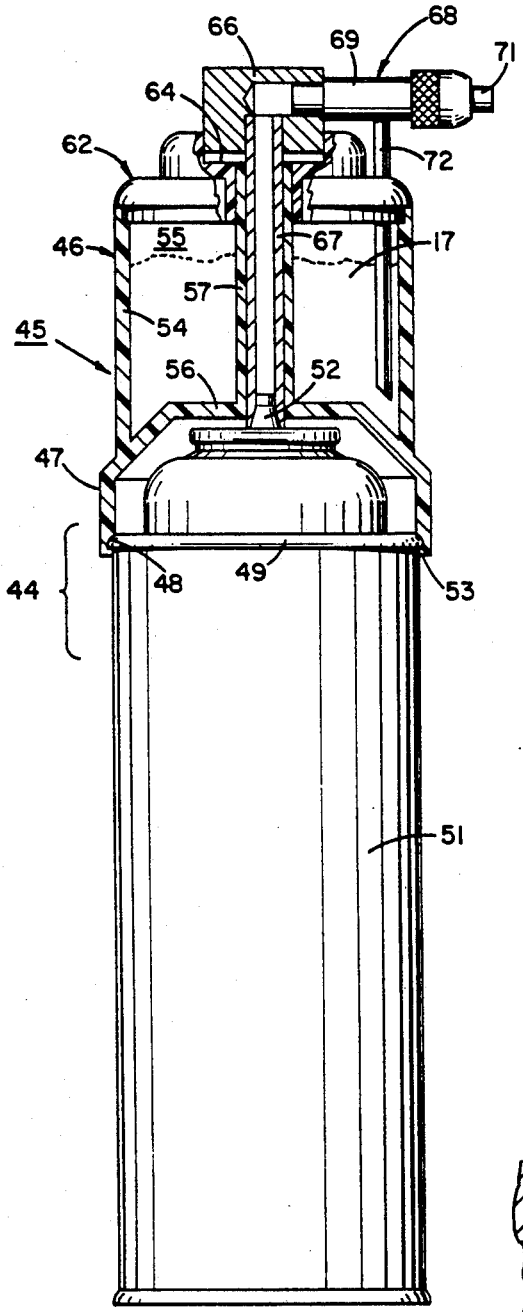
FIG. 7
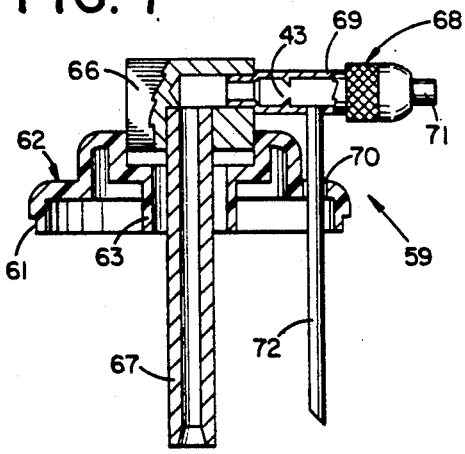
FIG. 8
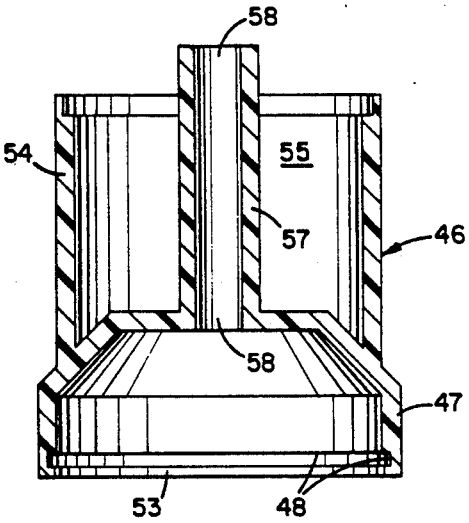
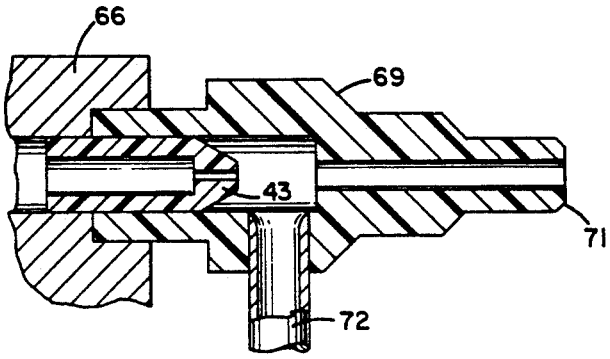
FIG. 9

SELF-POWERED UNITARY PORTABLE GRANULAR PARTICLE EJECTOR TOOL

CROSS-REFERENCE TO RELATED APPLICATION

This is a continuation-in-part of my co-pending U.S. patent application Ser. No. 07/762,920, filed Sept. 19, 1991, abandoned having the same title.

1. Field of the Invention

This invention relates to portable self-powered ejector tools for delivering streams of granular particles such as abrasives or fine sand to be used in many different applications, such as "carving" or "frosting" glass or metal objects through stencils, sandblasting or cleaning battery terminals or other parts of automobiles or machinery and particularly electrical terminals, or the delivery of an ejected stream of powdered or particulate material for any desired purpose using a unitary portable ejector tool.

2. Background of the Invention

Various kinds and sizes of particulate abrasive delivery tools have been proposed in the past, including portable assemblies incorporating an abrasive hopper, a nozzle and a trigger for initiating the delivery of the abrasive stream, such as U.S. Pat. Nos. 4,941,298; 4,628,644; 3,163,963 and 2,133,149. However, each of these assemblies requires the addition of a remote source of compressed air or other pressurized driving gas to actuate the device. Other proposals employ separate or remote hoppers of abrasive particles, such as U.S. Pat. Nos. 4,090,334 and 4,674,239, but again, these patents also employ remote sources of compressed air as the source of the driving fluid. German patent publication DE 3624023 A1 proposes several different "portable sandblaster" devices incorporating a container of compressed propellant gas, but these German proposals lack valuable features and important advantages of the present invention.

BRIEF SUMMARY OF THE INVENTION

The devices of this invention incorporate the supply hopper of particulate material and the delivery nozzle and control valve or trigger, combined with a source of pressure which is self-contained, thus forming a unitary portable and symmetrically balanced hand tool permitting the user to transport the entire assembly conveniently in one hand to the site of operation, and using a simple top-trigger mechanism to initiate Venturi aspiration upward from the bottom of the hopper and delivery of the stream of abrasive particles directed by the nozzle to the precise target location desired, using only one hand and avoiding any need for connecting hoses, tubing, compressed air cylinders or any separate components whatsoever.

Accordingly, a principal object of the present invention is to provide unitary portable and self-powered granular particle ejector tools combining the supply of granular particles with all components required for their delivery at the desired location.

Another object of the invention is to provide such unitary portable ejector tools requiring no additional elongated hoses or tubing and no separate component parts.

Still another object of the invention is to provide such unitary portable ejector tools adapted for separation of the supply hopper from the remainder of the assembly for refilling.

A further object of the invention is to provide such a unitary portable ejector tool capable of convenient separation into a refillable and reusable compressed gas propellant container, and a detachable assembly incorporating a refillable supply hopper for granular particulate materials to be ejected.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

THE DRAWINGS

For a fuller understanding of the nature and objects of the invention, reference should be made to the following detailed description taken in connection with the accompanying drawings, in which:

FIG. 6 is an assembled side elevation view, partially in section, showing a further preferred embodiment of the invention;

FIG. 7 is a cross-sectional side elevation view of the trigger-nozzle-hopper lid subassembly of the embodiment of FIG. 6;

FIG. 8 is a cross-sectional side elevation view of the hopper base component incorporated in the embodiment of FIG. 6;

FIG. 9 is an enlarged fragmentary side elevation view of a molded plastic delivery nozzle in a modified embodiment.

BEST MODE FOR CARRYING OUT THE INVENTION

Figure 1:
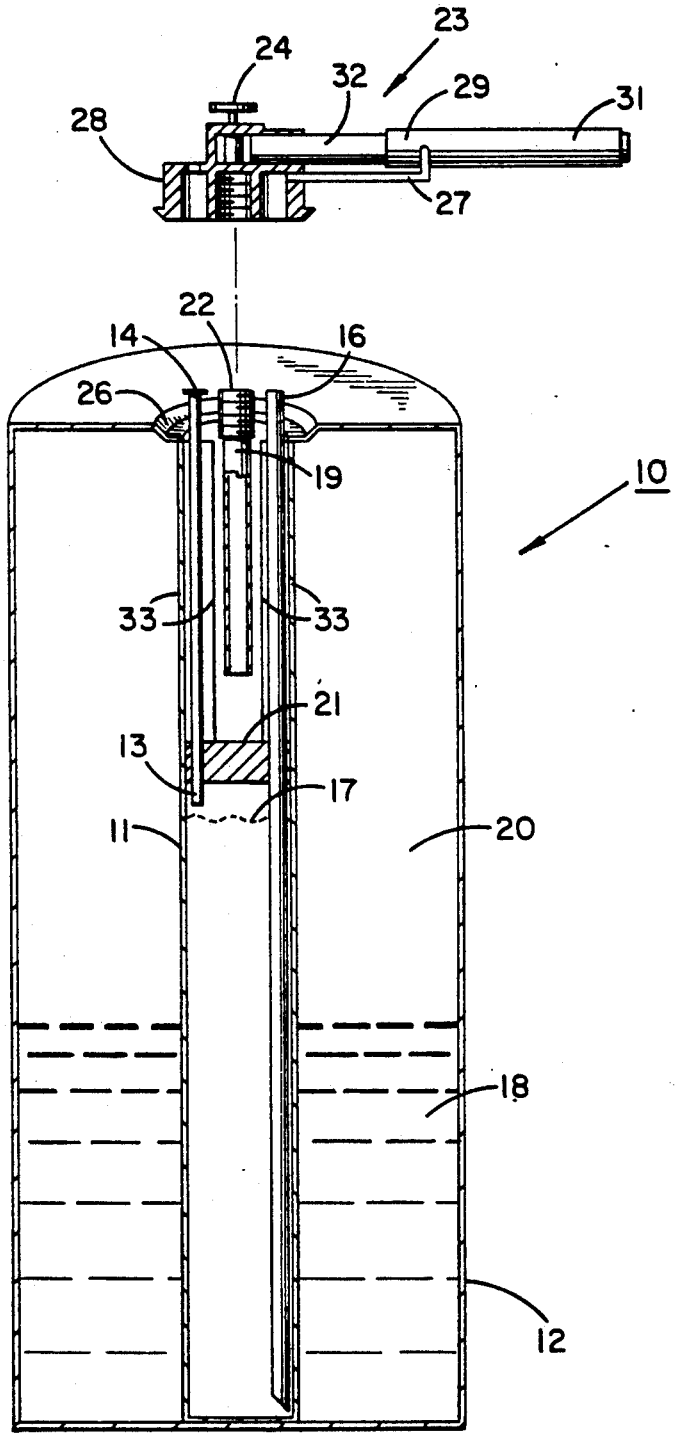
FIG. 1 is an exploded side perspective cross-sectional view showing one preferred embodiment of the invention.

Several different preferred embodiments of the invention are shown in the drawings. In FIG. 1, a disposable, throw-away embodiment 10 is shown incorporating a supply hopper 11 formed as an enclosed chamber aligned along the central axis of the device inside an external propellant tank 12. Supply hopper 11 is filled with the granular particulate material to be ejected by the tool during its fabrication, and hopper chamber 11 is sealed by an upper cap 21, leaving only two conduits leading to the outside of the device: a vent conduit 13 connected to the ambient atmosphere, with a suitable screen or filter 14 preventing the entry of foreign matter, dust or other contaminants, and a delivery conduit 16 extending from the bottom of the supply hopper 11 to the top of the assembly.

As shown in FIG. 1, a supply of granular particles 17 substantially fills the supply hopper 11 up to a level close to the lower end of the vent conduit 13. The propellant tank 12 is filled with a quantity of liquefied compressed propellant 18, preferably an environmentally safe liquid such as butane, with a gas vapor phase 20 above the level of the liquid phase propellant 18 inside propellant tank 12.

Compressed gas pickup tube 19 extends downward form the top of the assembly to a point near the upper end of supply hopper 11, which is closed by a screw cap 21 through which vent tube 13 extends. The pickup tube 19 is connected at its upper end to a delivery valve 22 which is normally closed, maintaining the pressurized liquid and gas phases 18 and 20 of the propellant inside the tank 12 ready for release whenever delivery valve 22 is actuated.

A trigger-nozzle unit 23 is shown detached above propellant tank 12 in the exploded view of FIG. 1, and the trigger-nozzle unit 23 incorporates a valve cap 28, enclosing valve 22, which is adapted to be lowered and connected to the upper end of the tank assembly 12. A trigger button 24 is operatively connected to actuate valve 22. Trigger-nozzle unit 23 co-acts with a welded top rim portion 26 of tank assembly 12, enclosing the upper end of tank 12 and the upwardly extending portion of delivery conduit 16, and the filter end 14 of vent conduit 13.

Figure 5:
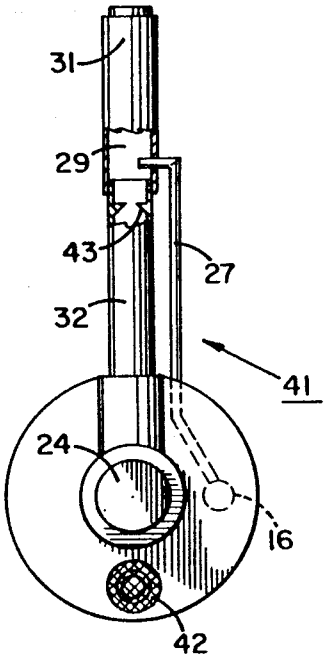
FIG. 5 is an enlarged top plan view of the subassembly of FIG. 4, partially broken away to disclose the venturi orifice through which compressed propellant gas enters the mixing chamber.

When cap 28 of trigger-nozzle 23 is lowered for assembly with and operatively connected to tank 12, the upper end of delivery conduit 16 communicates directly with a delivery tube 27 integrally formed in valve cap 28 enclosing valve 22. Tube 27 connects delivery conduit 16 to a mixing chamber 29 inside the nozzle portion 31 of the trigger-nozzle assembly 23. Propellant released from inside the pressure tank 12 by trigger button 24 through the actuated valve 22 is delivered through a central pressure conduit 32 in cap 28 into mixing chamber 29 through a Venturi orifice 43 (FIG. 5). This produces a high velocity jet of the propellant in mixing chamber 29, drawing a partial vacuum by Venturi action. Granular particles from the bottom of hopper 11 are aspirated by the pressure differential, between this negative pressure and atmospheric pressure via vent 13, and drawn through delivery conduit 16 and delivery tube 27 for direct ejection through nozzle 31 in a stream which remains continuous as long as trigger button 24 is depressed by the user.

A pair of support rods 33 suspend the supply hopper 11 from welded top rim portion 26 inside tank 12 and the lower end of hopper 11 may extend downward into abutting contact with the bottom of tank 12, as indicated in FIG. 1.

When either the supply of propellant in tank 12 or the supply of granular particles in hopper 11 have been exhausted, the trigger-nozzle assembly 23 may be unscrewed and removed from the upper end of the tank 12 and the exhausted tank 12 may be discarded and replaced by a fresh tank 12 containing a full supply of propellant 18 and 20 and particles 17 in order to make the assembly of the new tank 12 with the trigger-nozzle unit 23 fully ready for use.

SECOND EMBODIMENT WITH DETACHABLE AND REFILLABLE PARTICLE HOPPER

Figure 2:
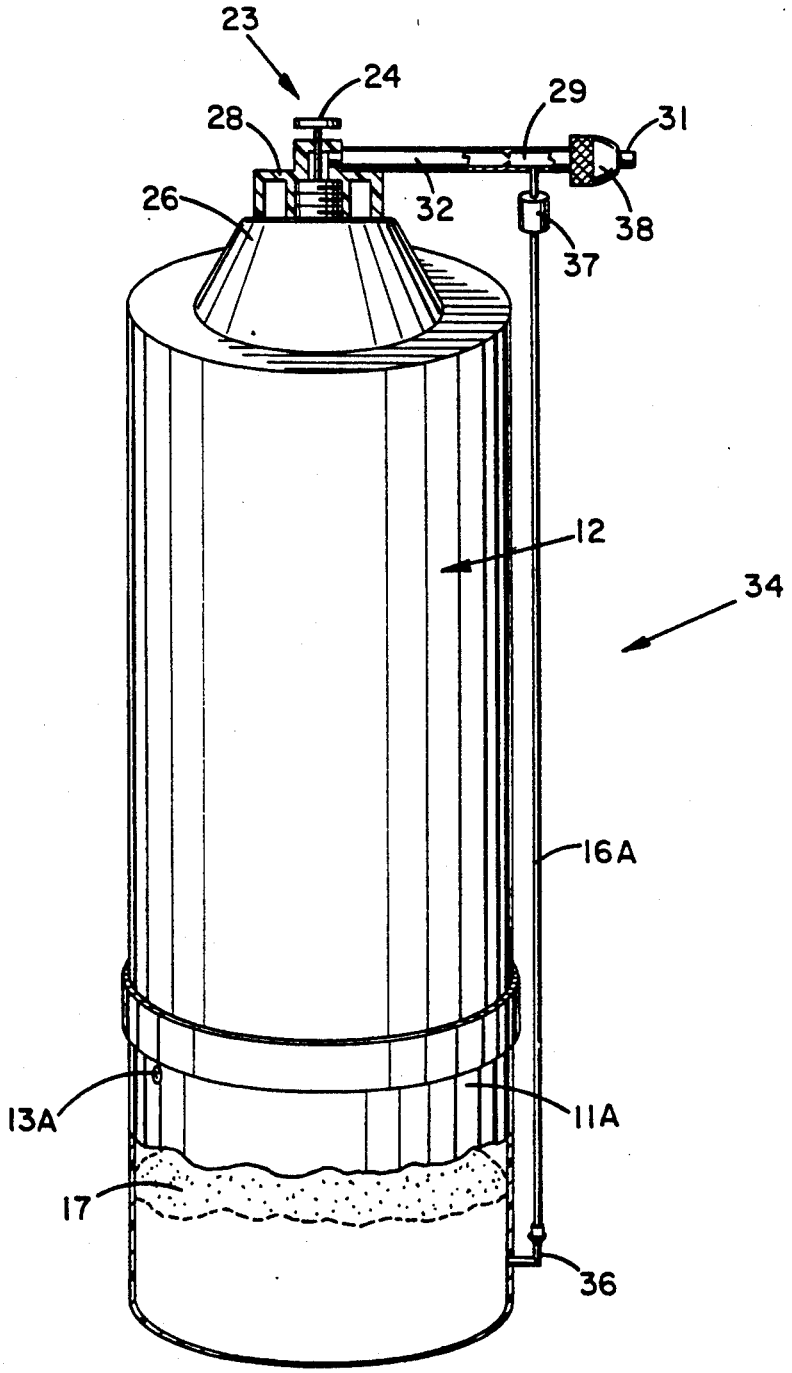
FIG. 2 is an assembled side perspective view, partially in cross-section, showing another preferred embodiment.

A hopper embodiment 34 of the invention is illustrated in FIG. 2 with a conventional "aerosol" can forming the pressurized propellant tank 12 in the central portion of the assembly 34. The lower end of the can 12 has a rolled rim over which is snapped, with a resilient force fit, an inverted molded plastic cap-style hopper 11A shown cut away in FIG. 2 to illustrate its load 17 of granulated particles exhausted inside.

Trigger-nozzle assembly 23 is mounted at the upper end of the aerosol can forming tank 12, incorporating valve cap 28, a trigger button 24, a pressure conduit 32, a mixing chamber 29, a nozzle 31 and a construction similar to that illustrated in FIG. 1. In this second embodiment, however, a delivery conduit 16A is positioned outside the assembly, and it extends from a connector tube 36 communicating with the inside lower portion of hopper 11A at the lower end of the assembly 34, upward to a flow control adjustment needle valve 37 communicating directly with mixing chamber 29.

The nozzle tip 31 is secured to the mixing chamber 29 by a nozzle retainer 38. Actuation of trigger button 24 releasing pressure from inside tank 12 through a small diameter Venturi orifice 43 leading directly to mixing chamber 29 (FIG. 5) draws a partial vacuum inside the mixing chamber, and the difference between this reduced pressure in conduit 16A and atmospheric pressure admitted to the inside of hopper 11A through vent 13A formed in the upper wall portion of the hopper 11A aspirates the granular particulate material 39 from the bottom of hopper 11A, causing it to be drawn through connector tube 36 and delivery conduit 16A into and through the flow control needle valve 37, to the mixing chamber 29, from which it is ejected in the stream of propellant and granulated particles through nozzle 31 toward the desired target site. Vent 13A in the upper side wall of hopper 11A is provided with an internal screen to protect the contents of the hopper from contamination.

In this second embodiment, the delivery conduit 16A may be formed as a flexible hose or tube which may be connected by a snap fit to the connector tube 36, and the disconnection of conduit 16A therefrom allows hopper 11A to be removed, by prying it from the lower rolled rim of tank 12, for refilling with a fresh supply of granular particles 17, after which the hopper 11A may again be attached by its force or snap fit over the lower rolled rim of tank 12 and conduit 16A may again be connected to connector tube 36.

This second embodiment also allows a new pressurized propellant tank 12 to be substituted in the assembly simply by unscrewing the cap 28 of trigger-nozzle unit 23 from the welded top rim portion 26 at the upper end of tank 12, and removing hopper 11A from its lower end, so that these respective components may be attached to a fresh fully-filled compressed propellant tank 12.

THIRD EMBODIMENT OF THE INVENTION WITH SEPARABLE TRIGGER-NOZZLE-HOPPER ASSEMBLY

Figure 4:
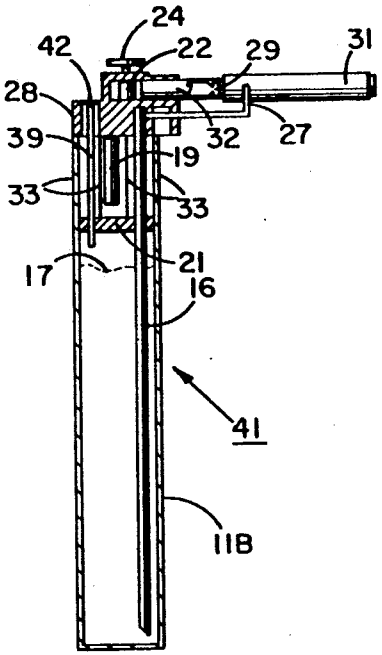
FIG. 4 is a side elevation view, with its lower end in cross-section, showing the trigger-nozzle-hopper subassembly incorporated in the embodiment of FIG. 3.
Figure 3:
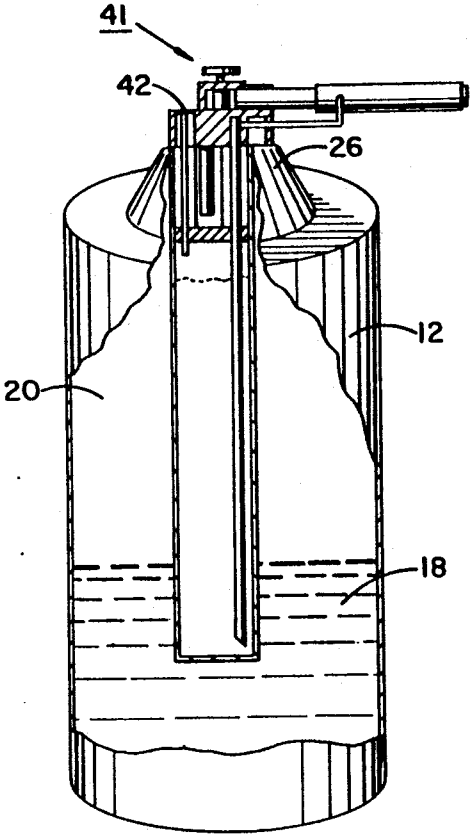
FIG. 3 is an assembled side perspective view, partially broken away, showing still another preferred embodiment.

FIGS. 3, 4 and 5 illustrate a third embodiment 40 of the invention incorporating a separate trigger-nozzle-hopper assembly 41 illustrated in FIG. 4, and shown installed with its hopper portion extending inside the propellant tank in FIG. 3. The combined trigger- nozzle-hopper assembly 41 illustrated in FIG. 4 incorporates an elongated cylindrical hopper 11B closed by a top closure cap 21 and supported by support rods 33 extending from the upper end of hopper 11B to the underside of the nozzle cap 28.

As shown in the enlarged top view of FIG. 5, in this embodiment of the invention a vent tube 39 extends from a screened vent 42 in the top of the device, best shown in FIG. 5, downward between rods 33 in the open upper portion of the trigger-nozzle-hopper assembly 41 through cap 21 into the interior of hopper 11B, thus introducing atmospheric pressure above the granular particulate material 17 enclosed in hopper 11B, with the screen in vent 42 blocking the entrance of any contaminating particles. The propellant gas pickup tube 19 extends downward from the valve cap 28 enclosing delivery valve 22 beneath trigger button 24, and the open lower end of tube 19 positioned between support rods 33 admits pressurized propellant gas 20 from the region above the liquefied propellant 18 in tank 12. When trigger button 24 is depressed, the pressurized gas is delivered through the pressure conduit 32 of trigger-nozzle-hopper assembly 41 to mixing chamber 29 through a reduced diameter Venturi orifice 43.

The resulting negative pressure aspirates granular particulate material from the bottom of hopper 11B through delivery conduit 16 and delivery tube 27 into mixing chamber 29 for ejection at high velocity through nozzle 31. In the partially cross-sectional top plan view of FIG. 5, the reduced diameter orifice 43 is shown at an intermediate point between trigger 24 and nozzle 31, just upstream from mixing chamber 29, and from the delivery end of delivery tube 27, through which the granular particles are drawn by the negative pressure in mixing chamber 29 for admixture into the ejected stream of compressed gas ejected through nozzle 31.

For ease of fabrication, the support rods 33 may conveniently be formed as arcuate segment portions of a cylindrical metal structure, with cutaway slots between them through which the compressed gas 20 is delivered to gas pickup tube 19.

The various embodiments of the invention thus facilitate the convenient portability of these unitary self-powered ejector tools, as well as the disassembly and reuse of the separable hopper 11A in the embodiment shown in FIG. 2, and the replacement of the entire compressed gas propellant tank 12 in the embodiments of FIGS. 2 and 3. The trigger-nozzle assembly of FIG. 1 and the trigger-nozzle hopper assembly of FIGS. 3 and 4 may be formed of metal or they may be formed of plastic parts for economy and convenience of fabrication. The compressed propellant tank 12 will normally be made of metal for resistance to the working pressures involved in filling the compressible propellant and in its storage, when warm ambient temperatures may increase the pressure within the container.

TRIGGER-NOZZLE-HOPPER ASSEMBLY SURMOUNTING STANDARD PRESSURIZED CONTAINER

Two further preferred embodiments 44 of the invention, shown in FIGS. 6 to 10, provide several unique advantages and are therefore considered to be the best modes for carrying out the invention.

In FIG. 6, the upper portion of the unitary assembly 44 is a trigger-nozzle-hopper assembly 45. This assembly is characterized by a top-mounted hopper 46 having a hopper base 47 with a peripheral internal groove 48 inside its lower circular rim, dimensioned for a snap-fit on the uppermost rolled rim 49 of propellant tank 51, which is a standard "aerosol" container with a central top axial plunger-type pressure relief valve 52, of the kind widely used for spray paint, liquid wax or lubricant spray products.

Hopper 46 and its unitary base 47 are preferably molded of tough resilient polymer, and the lower edge of internal groove 48 is defined by an inward protruding lowermost ridge or shelf 53 fitting securely under rolled rim 49 of tank 51 to anchor assembly 44 together securely during normal use.

Hopper 46 encloses an internal ring-shaped reservoir chamber 55 for granular particulate material, bounded by a circular outer wall 54, a floor 56, and a columnar central axial tube 57 enclosing a central bore 58 extending vertically through hopper 46, overlying plunger valve 52 of propellant tank 51 when hopper 46 is resiliently snap-fitted thereon.

The trigger-nozzle-hopper lid subassembly 59, shown in cross-section in FIG. 7, is assembled with the remaining components, as shown in FIG. 6. Rim 61 of hopper lid 62 engages the open upper end of wall 54, and is preferably heat-sealed or adhesively bonded to form a permanently closed chamber 53 already loaded with a full charge of particulate granular material.

Hopper lid 62 has a downwardly protruding central collar 63 telescoping with the upper end of tube 57, with only a narrow clearance space between them to vent chamber chamber 53 to the atmosphere. Above collar 63, the upper face of lid 62 is formed with a recess 64 freely accommodating a depressible trigger 66. Depending axially from trigger 66 is a rigid hollow gas pick-up tube 67 extending downward. When assembled with cap 62, the lower end of gas pick-up tube 67 inside bore 58 in central tube 57 of hopper 46 engages plunger valve 52 of tank 51.

Internal pressure inside the pressurized propellant tank 51 normally maintains plunger valve 52 closed. The user's finger pressure applied downward to depress trigger 66 overcomes this internal pressure, releasing propellant gas from tank 51 through valve 52 into pick-up tube 67.

An ejector 68 extending radially from trigger 66 comprises a tubular pressure conduit 69, having its proximal end anchored in a lateral bore in trigger 66, communicating with the interior of gas pick-up-tube 67, and its distal end opening into an ejection nozzle 71. Depending from pressure conduit 69 is a delivery conduit 72 extending downward substantially parallel to tube 67 through a mating aperture 70 in lid 62 into the lower interior portion of chamber 53, as shown in FIG. 6. An internal Venturi orifice 43 inside conduit 69 between trigger 66 and delivery conduit 72 is shown in FIGS. 7 and 9.

Parallel tubes 67 and 72 are free to slide vertically in lid 62 as trigger 66 is depressed. This downward movement of trigger 66 thus releases compressed gas from tank 51 through Venturi orifice 43 in pressure conduit 69. The resulting negative pressure downstream from orifice 43 aspirates granular material from chamber 53 and draws it through delivery conduit 72 into the mixing chamber inside pressure conduit 69; the mixed stream of compressed gas and granular material is thus ejected through nozzle 71 as long as the user maintains trigger 66 depressed into recess 64. Chamber 53 is vented through the sliding clearance space between conduit 72 and aperture 70, or between tube 57 and collar 63, and between recess 64 in lid 62 and trigger 66, admitting atmospheric pressure into chamber 53, and thus creating the pressure differential required for suction of granular material up delivery conduit 72 whenever trigger 66 is depressed.

Granular abrasion of nozzle 71 eventually enlarges the bore of the nozzle, and if nozzle 71 is formed of hard metal, as indicated in FIG. 7, a long useful life can be achieved. Alternatively, if nozzle 71, Venturi orifice component 43 and the other components of the trigger-nozzle-hopper assembly 45 are all molded of suitable polymer material, as indicated in FIG. 9, their manufacturing cost is minimal and they can be adhesively bonded to form a unitary assembly, and sold as a one-time disposable throwaway unit, to be discarded when the original charge of granular particulate material in chamber 53 is exhausted, and replaced by a new trigger-nozzle-hopper assembly 59 whenever desired.

Throwaway assembly 59 (FIGS. 9 and 10) has hopper lid 62 sonic-welded to walls 54, sealing hopper 46 for one-time use. When a metal nozzle 71 is employed, as shown in FIG. 7, hopper lid 62 may be joined to hopper walls 54 by a threaded connection, assuring that hopper 46 can be readily opened for re-filling and then readily closed for repeated use.

Figure 10:
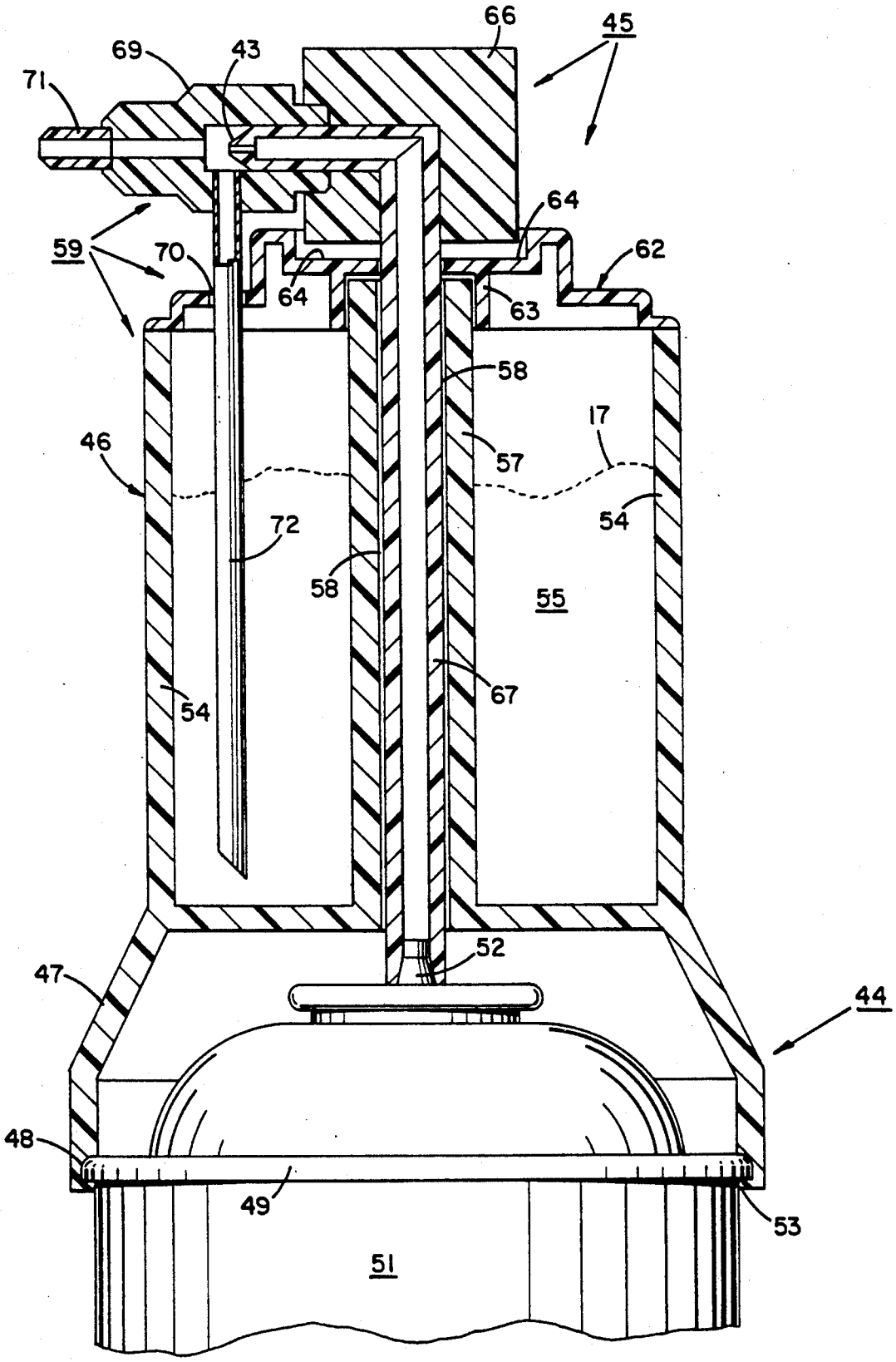
FIG. 10 is an enlarged fragmentary side elevation view of the hopper and trigger-nozzle assembly of that modified embodiment.

The slightly modified version of the throwaway unit shown in FIG. 10 has the same components illustrated in FIG. 9, identified by the same reference numerals.

All of the embodiments of the invention are relatively light in weight, symmetrically balanced and conveniently portable and operable by the user with one-hand operation. The user is thereby provided with a single unitary self-powered tool for delivery of abrasive powders and other granular materials to any desired target site, without requiring both hands to carry and actuate the unit, avoiding the encumbrances of compressors, compressed gas tanks, hoses, tubing and the like.

It will thus be seen that the objects set forth above, and those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also understood that the following claims are intended to cover all of the generic and specific features of the invention herein described and all statements of the scope of the invention which, as a matter of language, might be said to fall therebetween.

What is claimed is:

1. A unitary, portable, self-powered tool for ejecting a stream of granular particulate materials toward a target site comprising:

a portable propellant container, enclosing compressed propellant liquid, with a sealable top opening, a hollow hopper, with a storage chamber accommodating a supply of granular particles, connected to and supported by the container, a sealing nozzle cap connected to the container and sealing its top opening, means forming a vent connecting ambient atmosphere to the inside of the hopper chamber, a pressure valve between the container and the nozzle cap for releasing the propellant as compressed gas, a trigger extending outward from the nozzle cap connected to actuate the pressure valve, a nozzle protruding from the nozzle cap, means forming a mixing chamber in the nozzle cap positioned above the uppermost level of the supply of granular particles in the hopper and connecting the pressure valve to the nozzle, a delivery conduit connecting a lower end of the hopper chamber to the mixing chamber, and means forming a reduced diameter orifice in the nozzle cap between the pressure valve and the mixing chamber, positioned to produce enhanced negative pressure promoting aspiration of particles from the hopper chamber through the delivery conduit to the mixing chamber, all of said components being combined for use in a symmetrically balanced unitary portable assembly which can be seized, carried, aimed and operated by the user in only one hand to eject the granular particles.

2. The ejector tool defined in claim 1 wherein the hopper and the delivery conduit are external and closely adjacent to the propellant container.

3. The ejector tool defined in claim 2, further incorporating an adjustable flow control valve interposed in the delivery conduit adjacent to the mixing chamber.

4. The ejector tool defined in claim 1 wherein the vent is closely adjacent to the nozzle cap.

5. The ejector tool defined in claim 1 wherein the vent is provided with a filter screen preventing contaminants from entering the hopper chamber through the vent.

6. The ejector tool defined in claim 1 wherein the hopper is removably detachable from the container for refilling.

7. The ejector tool defined in claim 1 wherein the hopper is positioned inside the container.

8. The ejector tool defined in claim 7 wherein the hopper and the nozzle cap are joined together as a subassembly, incorporating the delivery conduit, the vent, the trigger, the mixing chamber and the nozzle, which may be removably installed as a single unit inside the propellant container.

9. A unitary, portable, self-powered tool for ejecting a stream of granular particulate materials toward a target site comprising:

a portable propellant container, enclosing compressed propellant liquid, with a sealable top opening, a depressible plunger valve connected to the container and sealing its top opening, for releasing the propellant as compressed gas, a hollow hopper, with a storage chamber accommodating a supply of granular particles, connected to and supported by the container, means forming a vent connecting ambient atmosphere to the inside of the hopper chamber, a trigger extending outward from the hollow hopper connected to actuate the plunger valve, a nozzle protruding from the trigger, means forming a mixing chamber positioned above the uppermost level of the supply of granular materials in the hopper and connecting the plunger valve to the nozzle, a delivery conduit connecting a lower end of the hopper chamber to the mixing chamber, and means forming a reduced diameter orifice in the nozzle cap between the pressure valve and the mixing chamber, positioned to produce enhanced negative pressure promoting aspiration of particles from the hopper chamber through the delivery conduit to the mixing chamber, all of said components being combined for use in a symmetrically balanced unitary portable assembly which can be seized, carried, aimed and operated by the user in only one hand.

10. The ejector tool defined in claim 9 wherein the hopper, the trigger and the nozzle are combined as a single assembly mounted on top of the propellant container.

11. The ejector tool defined in claim 9 wherein the hopper is detachably mounted on top of the propellant container, and the trigger is depressibly mounted in a recess formed in the hopper with a propellant pick-up tube extending from the trigger through the hopper into engagement with the plunger valve.

12. The ejector tool defined in claim 11, wherein the mixing chamber is formed in a pressure conduit connecting the pick-up tube to the nozzle.

13. The ejector tool defined in claim 12 wherein the trigger, the pressure conduit, the nozzle, the pick-up tube and the delivery conduit are all joined together as a unitary assembly mounted for depressible reciprocating movement in the hopper between a depressed position actuating the plunger valve and a released position deactuating the plunger valve.

14. The ejector tool defined in claim 11 wherein the vent is positioned closely adjacent to the propellant pick-up tube and is connected to the ambient atmosphere via said trigger recess.

15. The ejector tool defined in claim 12 wherein the delivery conduit is substantially parallel to the propellant pick-up tube, with said delivery conduit and said pick-up tube being slidably mounted for reciprocating movement in respective slide-apertures formed in the hopper, whereby depressing actuation of the trigger actuates the plunger valve, releasing propellant through the Venturi orifice to produce negative pressure in the mixing chamber, aspirating granular material from the lower end of the hopper chamber and delivering a stream of propellant carrying granular material through the nozzle.

* * * * *